United States Patent [19]

Lee

[11] Patent Number: 4,624,341

[45] Date of Patent: Nov. 25, 1986

[54] ELEVATABLE STOOL CONSTRUCTION

[76] Inventor: David B. Lee, 2375 Tipperary Ave., South San Francisco, Calif. 94080

[21] Appl. No.: 771,760

[22] Filed: Sep. 3, 1985

[51] Int. Cl.[4] ..... E04G 3/16

[52] U.S. Cl. ..... 182/15; 108/144; 182/33; 248/188.2; 297/461

[58] Field of Search ..... 297/461, 462, 345, 438; 108/144, 148; 182/15, 33; 248/161, 188.2

[56] References Cited

U.S. PATENT DOCUMENTS

| | | | |
|---|---|---|---|
| 314,831 | 3/1885 | Hardy | 248/161 |
| 2,523,817 | 9/1950 | Conley et al. | 248/405 |
| 2,742,953 | 4/1956 | Kudrna | 248/405 |
| 2,931,685 | 4/1960 | Butler | 108/144 X |
| 3,227,112 | 1/1966 | Wiseman | 108/144 |
| 3,559,761 | 2/1971 | Wehner | 182/15 |
| 3,599,750 | 8/1971 | Serwer | 182/15 |
| 4,155,423 | 5/1979 | Miller | 182/15 |
| 4,232,901 | 11/1980 | Harrington et al. | 297/439 |

*Primary Examiner*—James T. McCall

*Attorney, Agent, or Firm*—Henderson & Sturm

[57] ABSTRACT

An extensible foot stool apparatus (10) comprising a generally conical housing unit (11) having retractable roller units (12), and adapted to slideably and releasably receive a generally cylindrical primary weight supporting unit (13) in both a retracted and extended mode.

3 Claims, 4 Drawing Figures

ELEVATABLE STOOL CONSTRUCTION

TECHNICAL FIELD

The present invention relates generally to wheeled and/or adjustable constructions.

BACKGROUND OF THE INVENTION

The prior art is replete with adjustable stool constructions as may be seen by reference to U.S. Pat. Nos. 2,523,817; 2,742,953; 3,227,112 and 4,232,901.

While all of the aforementioned prior art devices are more than adequate for their intended purposes, they also all share common deficiencies in the complexity of their structures, the number of structural components involved, and their undue concern with incremental adjustments.

In most instances wherein a footstool is employed on a regular basis, the standard height or relatively short footstool configuration will be sufficient for the vast majority of tasks; however, there will be instances wherein a substantially greater height stool would be not only desirable but necessary.

In these latter instances the user would logically desire a foot stool construction wherein the stool support surface could be quickly transformed from a standard retracted height to a fully extended height. Unfortunately, the acknowledged prior art constructions do not lend themselves to that virtually instantaneous deployment.

Having isolated a major drawback in existing foot stool constructions, a solution to this problem was sought, and the end result of those efforts are embodied in the construction that forms the basis of the present invention.

BRIEF SUMMARY OF THE INVENTION

The present invention involves a foot stool apparatus, wherein the primary weight supporting unit nests within the foot stool housing unit, whereby the weight supporting unit may be grasped, lifted vertically, and then rotated with respect to the foot stool housing unit, to engage the bottom portion of the weight supporting unit with the top of the housing unit, thereby virtually doubling the effective height of the apparatus.

In addition to the above mentioned components, the housing unit is also provided with a plurality of retractable roller elements, whereby the apparatus may be rolled from place to place in either the retracted or extended mode, and the roller elements will retract within the housing unit upon the application of weight to the primary weight supporting unit.

BRIEF DESCRIPTION OF THE DRAWINGS

These and other objects, advantages and novel features of the invention will become apparent from the detailed description of the best mode for carrying out the preferred embodiment of the invention, particularly when considered in conjunction with the accompanying drawings wherein.

BEST MODE FOR CARRYING OUT THE INVENTION

Figure 1:
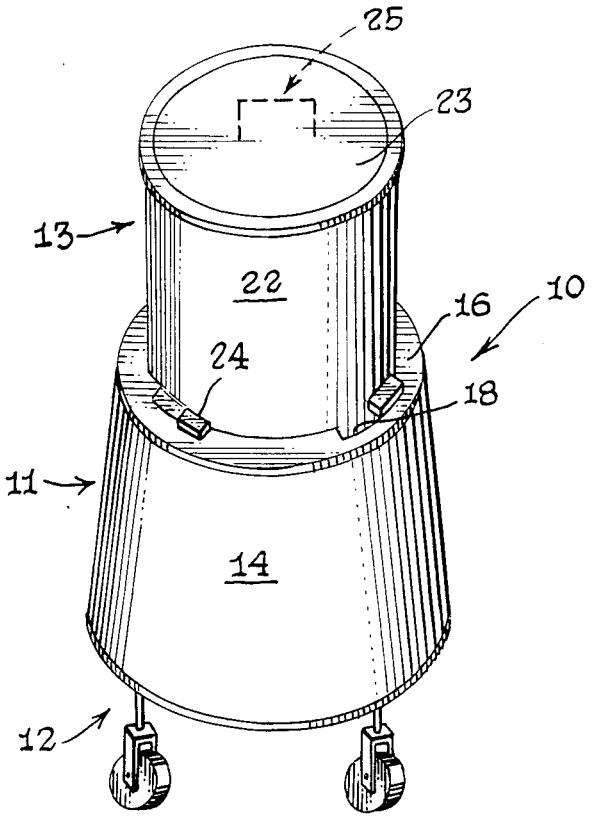
FIG. 1 is a perspective view of the foot stool apparatus in its extended position.

As can be seen by reference to the drawings and in particular to FIG. 1, the extensible foot stool apparatus of the present invention is designated generally by the reference numeral (10). The foot stool apparatus (10) comprises in general a housing unit (11), which is provided with retracted roller units (12), and which surrounds a primary weight supporting unit (13). These units will now be described in seriation fashion.

Figure 2:
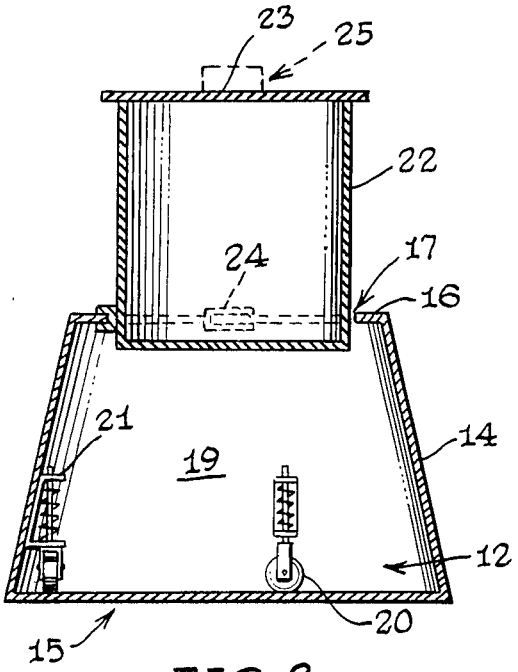
FIG. 2 is a cross-sectional view of the apparatus in its extended position.

As can best be seen in FIGS. 1 and 2, the housing unit (11) comprises a generally conical housing member (14) having an enlarged bottom opening (15), and an inwardly extending shoulder element (16) surrounding its relatively smaller opening (17). In addition, the shoulder element (16) is provided with a plurality of recesses (18) disposed around its periphery, whose purpose and function will be explained further on in the specification.

The housing unit (11) is also provided with a plurality of retractable roller units (12) disposed on the interior housing wall (19) proximate the enlarged bottom opening (15). As can best be seen in FIGS. 2 and 3, the roller units (12) comprise a spring biased wheel member (20) mounted for reciprocal movement with respect to a mounting bracket (21) fixedly secured to the interior housing wall (19).

The primary weight supporting unit (13) comprises an elongated generally cylindrical extension member (22) having an enlarged generally circular support surface (23) formed on its upper end, and a plurality of generally C-shaped temporary securing means in the form brackets (24) formed on its lower end.

Figure 3:
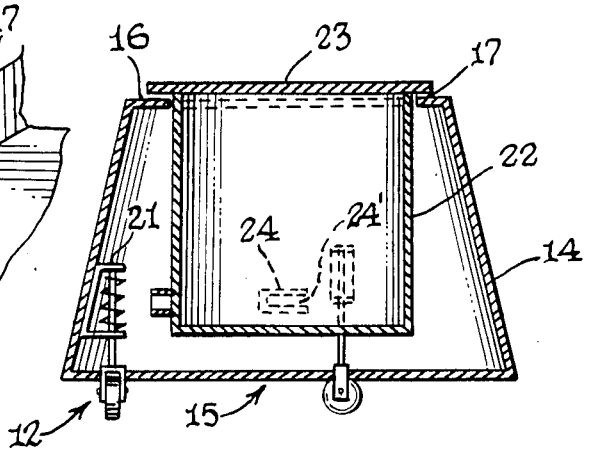
FIG. 3 is a cross-sectional view of the apparatus in its retracted position.

As can best be seen in FIGS. 2 and 3, the elongated generally cylindrical extension member (22) is dimensioned to be slideably received in the top opening (17) of said housing unit (11); and, the enlarged support surface (23) is dimensioned to rest upon the shoulder element (16) of the housing unit (11) when the foot stool apparatus (10) is disposed in its retracted mode.

Figure 4:
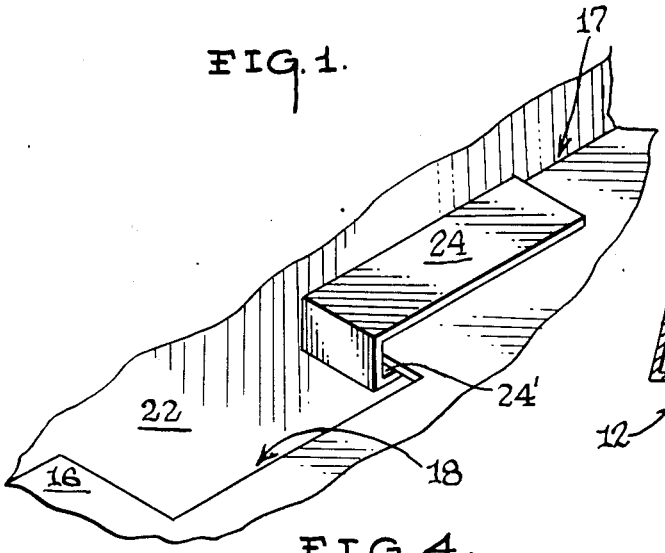
FIG. 4 is a detail view of the cooperating locking elements on the main components of the apparatus.

As can best be seen by reference to FIGS. 1 and 4, each of the generally C-shaped securing brackets (24) is dimensioned to at least partially extend through a respective one of said plurality of recesses (18) on the shoulder (16) of the housing unit (11).

To extend the apparatus (10) to its full effective height, as represented in FIGS. 1 and 2, the enlarged support surface (23), or recessed handle (25) shown in phantom, is grasped to raise the openings (24') of the C-shaped securing brackets (24) to an opposed position with respect to the shoulder (16) of the housing unit (11). At this point a slight rotary movement is imparted to the primary weight supporting unit (13) to releasably secure the primary weight supporting unit (13) in its extended position.

Having thereby described the subject matter of this invention, it should be fairly obvious that many substitutions, modifications, and variations of the invention are possible in light of the above teachings. It is therefore to be understood that the invention as taught and described herein is only to be limited to the extent of the breadth and scope of the appended claims.

I claim:

1. An extensible foot stool apparatus comprising:

a generally conical housing member having an enlarged opening formed on its bottom end, and a relatively smaller opening formed on its top end; and a generally elongated cylindrical extension member having an enlarged support surface formed on its upper end, wherein the extension member is slideably disposed within said housing member, and further provided with temporary securing means on its lower end which releasably engage the upper portion of the housing member; wherein, the housing member is further provided with an inwardly extending shoulder element surrounding said relatively smaller opening on said top end.

2. The foot stool apparatus as in claim 1; wherein, said shoulder element is further provided with a plurality of recesses disposed around its periphery.

3. The foot stool apparatus as in claim 2; wherein, said temporary securing means on said extension member comprise a plurality of securing brackets that are dimensioned to at least partially extend through said recesses on the shoulder element of said housing member.

* * * * *